US007770269B2

(12) United States Patent
Marchesi

(10) Patent No.: US 7,770,269 B2
(45) Date of Patent: Aug. 10, 2010

(54) APPARATUS AND METHOD FOR COMPACTING WEBS

(76) Inventor: Maria Francesca Marchesi, Via Rovani, 6, Monza (Milan) (IT) I-20052

( * ) Notice: Subject to any disclaimer, the term of this patent is extended or adjusted under 35 U.S.C. 154(b) by 82 days.

(21) Appl. No.: 12/009,670

(22) Filed: Jan. 22, 2008

(65) Prior Publication Data

US 2009/0031542 A1 Feb. 5, 2009

(30) Foreign Application Priority Data

Jul. 31, 2007 (IT) ..... MI07A1571

(51) Int. Cl.
*D06C 15/10* (2006.01)

(52) U.S. Cl. ..... 26/18.6; 28/165

(58) Field of Classification Search ..... 26/18.6; 38/17, 19, 21–24, 29, 28; 28/165, 100; 100/194, 100/207, 40, 195, 196, 215, 218, 221, 223, 100/264; 425/406, 407; 156/148, 184, 228, 156/190

See application file for complete search history.

(56) References Cited

U.S. PATENT DOCUMENTS

| | | | | |
|---|---|---|---|---|
| 320,006 | A * | 6/1885 | Shearer | 38/3 |
| 846,890 | A * | 3/1907 | Andree | 38/23 |
| 1,593,565 | A * | 7/1926 | Bredenberg | 69/48 |
| 2,007,726 | A | 7/1935 | Pickard | |
| 2,311,013 | A * | 2/1943 | Whitehead | 156/578 |
| 2,874,751 | A * | 2/1959 | Norton | 38/17 |
| 3,406,472 | A * | 10/1968 | Solomon | 38/17 |
| 3,609,891 | A * | 10/1971 | Ishizawa et al | 38/17 |
| 3,650,203 | A * | 3/1972 | Carlsson et al. | 100/327 |
| 3,758,968 | A | 9/1973 | Ishizawa et al. | |

FOREIGN PATENT DOCUMENTS

| | | |
|---|---|---|
| GB | 318450 | 9/1929 |
| GB | 376500 | 7/1932 |
| GB | 593504 | 10/1947 |
| JP | 2002249984 | 9/2002 |

OTHER PUBLICATIONS

International Search Report for PCT/EP2008/003203 filed on Apr. 18, 2008 in the name of Maria Francesca Marchesi.
Written Opinion for PCT/EP2008/003203 filed on Apr. 18, 2008 in the name of Maria Francesca Marchesi.

* cited by examiner

*Primary Examiner*—Amy B Vanatta
(74) *Attorney, Agent, or Firm*—Steinfl & Bruno

(57) ABSTRACT

The present invention relates to a apparatus for compacting (10) a web (N) of flexible fiber-based or filament-based material. The apparatus (10) includes at least one pair of superimposed plates (11), whose facing surfaces (11*a*, 11*b*) create therebetween at least one compaction space (12). The apparatus is fed with the continuous web (N), that is moved through said at least one space (12), so as to be subjected to compaction by the closure of the plates, actuated by thrust means (25). Moreover, the invention relates to a method for compacting webs (N) of flexible fiber-based or filament-based materials.

11 Claims, 8 Drawing Sheets

APPARATUS AND METHOD FOR COMPACTING WEBS

CROSS REFERENCE TO RELATED APPLICATIONS

This application claims priority to Italian Patent Application MI2007A001571 filed on Jul. 31, 2007 and may be related to U.S. patent application Ser. No. 12/373,288 filed on Jan. 9, 2009.

The present invention relates to a apparatus and a related method for compacting webs of flexible fiber-based or filament-based materials.

In particular, the invention concerns a apparatus and the related method for compacting flexible fiber-based or filament-based materials, and more particularly fabrics made in a continuous web form.

The technological field of elective application of the apparatus according to the invention is that of protective fabrics; however, any flexible fiber-based material, that needs compacting the fiber during its production, can be subjected to the compacting treatment in the apparatus according to the present invention.

Protective fabrics have been available on the market for more than 30 years.

They take advantage of the capacity of high tenacity fibers to deform the incoming threat and absorb its energy in excess by propagation of stress waves.

The first variants were composed of warp and weft fabrics of traditional type.

Although still used for the production of fabrics for personal protection garments, these fabrics have technical limits caused by the presence of overlaps between the weft and warp veins.

In these "knots", the stress caused by the impact on the protection (stress wave) is reflected with amplitude equal to the amplitude of the incident wave, stressing the fibers with a double stress; this phenomenon strongly reduces the resistance of fibers.

An improvement has been obtained by impregnating the warp and weft fabrics with suitable resins or by weaving unidirectional textile structures stabilized by matrices.

The resin or the matrix improves the energy absorption of the structures, since it increases the sliding friction between fibers, increasing the breaking work.

In order to improve the performance of these resined structures, it is necessary that the impregnation process be followed by a compacting process under pressure and temperature. In this way, the fibers are arranged in such a way that the single fibrils are lain substantially in a particularly thin plane, thus obtaining a high covering effect.

The quality of the product without this compacting process results insufficient.

Generalizing, one can estimate a 35% protection increase from non resined warp and weft fabrics to compacted unidirectional impregnated fabrics.

All the above mentioned fabrics are wound continuously on rolls of different dimensions.

Different techniques are known for the production of the above mentioned protective fabrics.

Some production techniques among weaving techniques and apparatus include:

- weft-warp looms;
- apparatus for producing unidirectional or semi-unidirectional fabrics;
- apparatus for producing multiaxial fabrics;

Some production techniques among impregnation techniques and apparatus include:

- immersion impregnating machines
- spray treatment impregnating machines;
- hot-melt process impregnating machines.

The compacting step is carried out by different techniques, used according to the article to be treated and with apparatuses that can be classified in the following groups.

Cylindrical roller calenders (continuous process)

Hot plate presses (discontinuous process)

Autoclaves (discontinuous process)

The cylindrical roller calenders include two or more parallel, opposite cylinder rollers, generally made of steel, possibly heated by oil or steam.

The fabric passes through the two or more rollers, so as to be subjected to compression and heating.

These machines have the undoubted advantage of obtaining a continuous production, however they have also limits.

Pressure that can be applied is in fact limited, since too big forces would deform the cylinders along the axis; this deformation would result in a fabric compacted in a non-uniform way, with consequent change of the protection characteristics.

Moreover, if the impregnating resin is of polymerizable or cross-linkable type, temperature and pressure application time is too short and a complete reaction is not obtained; therefore, it is necessary to provide more cylinders or more passages between the same cylinders, with consequent possibility of polymerization partly under pressure and partly without, which results in non-homogeneous areas with different protection characteristics.

Consequently, the apparatus cost is high, since it is necessary to provide more cylinders, which are trued and heated.

The hot plate presses are apparatus comprises two or more heating plates arranged therein.

These machines have the undoubted advantage of being able to work also at high pressures (the plates deformations, unlike the ones of the calender rollers, can be controlled more easily) and allow polymerization of the fabric impregnating resins, since the fabric can remain between the apparatus plates for the necessary time.

However, these apparatus have the limit of not allowing a continuous production.

Actually, it is not possible to compact the fabric as it is rolled up on the original roller, but it is necessary to unroll it, cut it to match the dimension of the plates, arrange it manually inside the apparatus, press it, remove it manually from the press, store it in sheets.

In the case of fabrics for personal protection, pressure plays a fundamental role: the higher the compacting pressure on the unidirectional structures, the better the fabric protection result.

In fact, compaction is generally accompanied by a reduction of the fabric thickness, which in turn increases its flexibility.

Typical compacting values are included between 6 and 280 $kg/cm^2$.

In case 1280×2150 mm sheets of fabric are to be produced (typical values of compacted parts of fabric available on the market) it is necessary to provide a press with a total thrust included between about 165 and 7700 tons.

This requirement implies a very big apparatus, that results in a cost which is about twice the calender apparatus cost.

Moreover, the limited surface of the apparatus makes the fabric producers cut the roll at a predetermined dimension, which results in material waste at the roll beginning and end.

In order to understand the disadvantage of using sheets of limited dimension, a proper concise explanation of the techniques used for producing personal protection devices (GAP) is advisable.

The above mentioned personal protection devices GAP are produced by cutting the high tenacity fabric according to predetermined patterns, whose superimposition allows obtaining a dynamic response to a threat, on the basis of the number of layers.

If the GAP producer buys rolls of fabric, he will spread more layers of fabric on a table with typical length of 8-10 m; after having spread more layers, placed one on another, he can start cutting them according to predetermined patterns, which optimize their use by reducing scraps and waste to a minimum.

Therefore, the GAP producer can choose such a length of the spread layers, that reduces scraps and waste to a minimum.

For example, FIG. 1 shows spread layers S with a 128 cm height H and a 790 cm length L, having reported thereon marks of a 1700 $cm^2$ standard template D, which repeats 54 times in the spread layers.

The resulting waste can be calculated as follows:

fabric dimension: 128 cm×790 cm=101,120 $cm^2$;

pattern dimension: 1700 $cm^2$×54 patterns=91,800 $cm^2$;

percentage waste=(91,800/101,120)*100=9.21%.

If the GAP producer works on the sheets of reduced size and not on the rolls of fabric, he will follow the same criterion, but the waste will increase.

In particular, taking into consideration the case, not shown, of a standard sheet of 128 cm×215 cm=27,520 $cm^2$, in which 12 patterns can be cut out, one obtains:

pattern dimension: 1700×12 patterns=20,400 $cm^2$ waste=(100−20,400/27,524)*100=25.87%.

(In the second example, the waste is of about 26%, compared to little more than 9% of the first example.)

Thus, it is obvious that a continuous web production allows a considerable waste reduction.

The applicant was able to resolve the above mentioned technical problem by an innovative apparatus for compacting webs.

According to a first aspect of the present invention, a apparatus for compacting a web of flexible fiber-based or filament-based material is provided, including at least a pair of opposite plates, whose facing surfaces delimit therebetween at least one compaction space, the apparatus being supplied with the continuous web, which is moved through at least one passageway, so as to be compacted by the plates closure, actuated by thrust means.

According to a different aspect of the present invention, the apparatus for compacting a web of flexible fiber-based or filament-based material includes a plurality of opposite compacting plates, whose facing surfaces delimit therebetween compaction spaces, and a plurality of rollers, situated upstream and downstream of the spaces for the web movement through said spaces.

These and other objects of the present invention have been obtained by a apparatus for compacting continues webs, according to appended claim 1.

Another object of the present invention is a method for compacting webs, according to appended claim 13.

Other characteristics are provided in the appended dependent claims.

The characteristics and advantages of the apparatus and method for compacting continues webs according to the present invention will become better evident from the following description, exemplifying and non-limiting, referred to the enclosed schematic drawings, in which:

FIG. 1 shows the marking, according to known technique, of protection element patterns of a web section (spread layers), having standard measures;

FIG. 2*a* is a schematic view of a detail of the apparatus for compacting, according to an embodiment of the present invention;

FIG. 2*b* schematically shows a detail of a compacting apparatus according to the present invention, in which a plurality of stacked compacting plates are provided;

FIGS. 3*a*-3*e* are schematic views of the operation in as many operation steps of a continues web compaction apparatus, equipped with more superimposed plates, according to a different embodiment of the invention;

Figure 1:
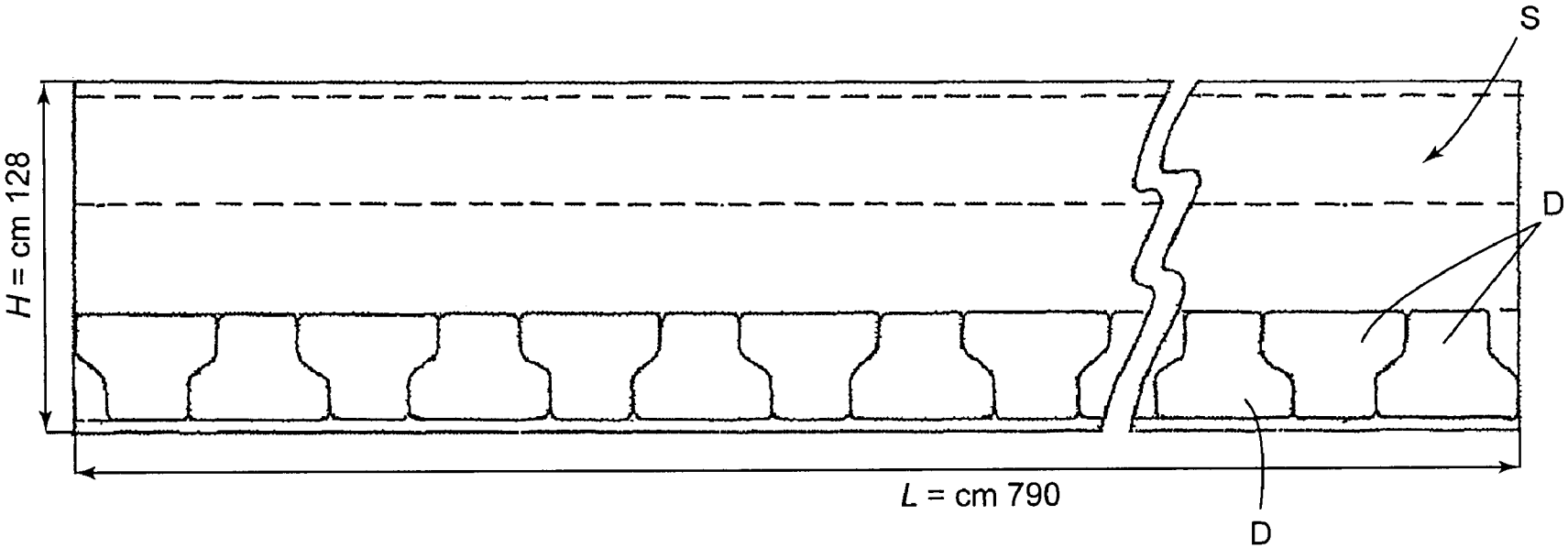
Fig. 1 Prior Art

With reference to Figures from 2*a* to 6, a apparatus 10 for compacting a continuous web N of flexible fiber-based or filament-based material includes at least a pair of superimposed plates 11, whose facing surfaces 11*a*, 11*b* delimit therebetween at least one compacting space 12.

The apparatus is supplied with the continuous web N, which is moved through said at least one space 12, so as to be subjected to compaction by the plates closure, actuated by thrust means 25.

In this case, the web N advantageously moves, with a controlled advancement, to allow the plates closure for the compaction, between an unwinding reel 14 and a winding reel 15.

The closure is performed by thrust means 25, which are preferably hydraulic or pneumatic cylinders.

Figure 2A:
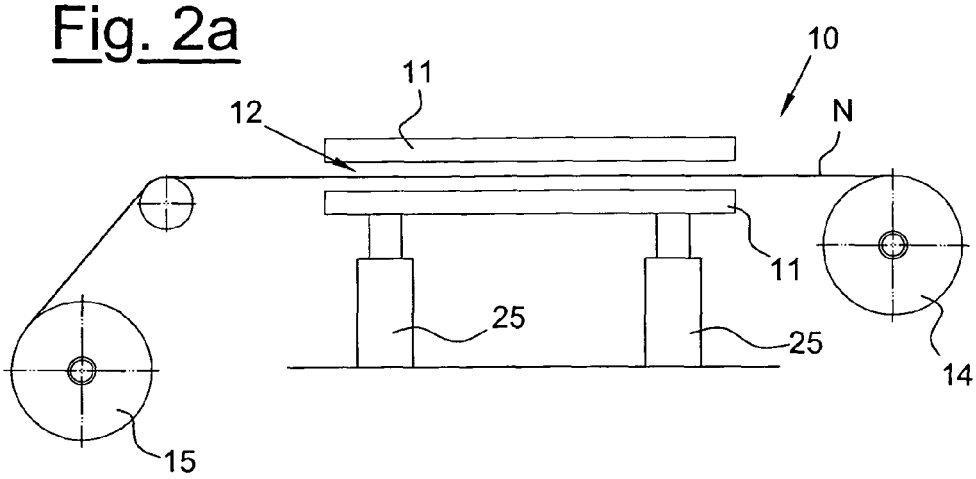
Figure 2B:
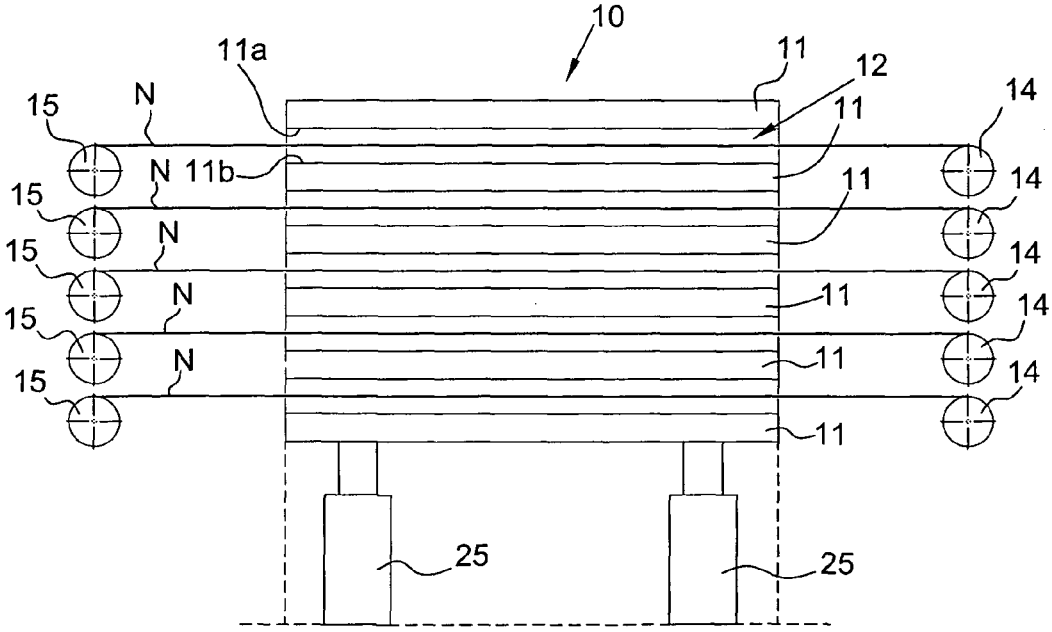
Figure 3A:
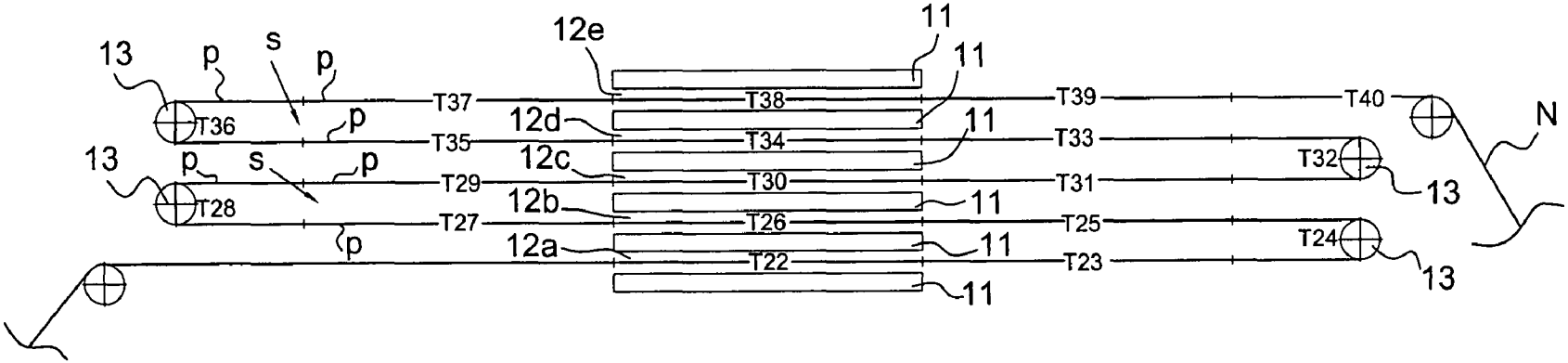
Figure 3B:
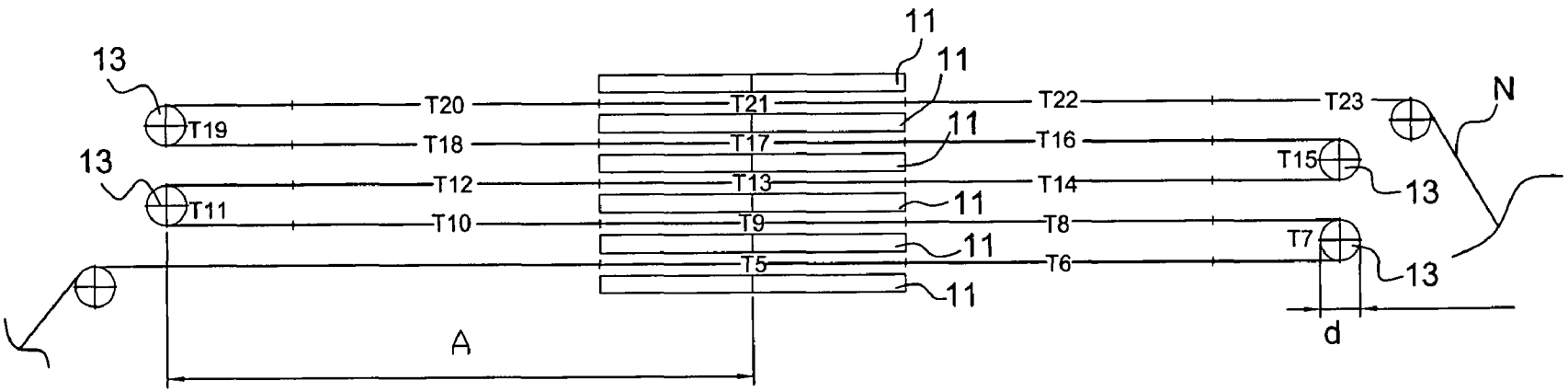
Figure 3C:
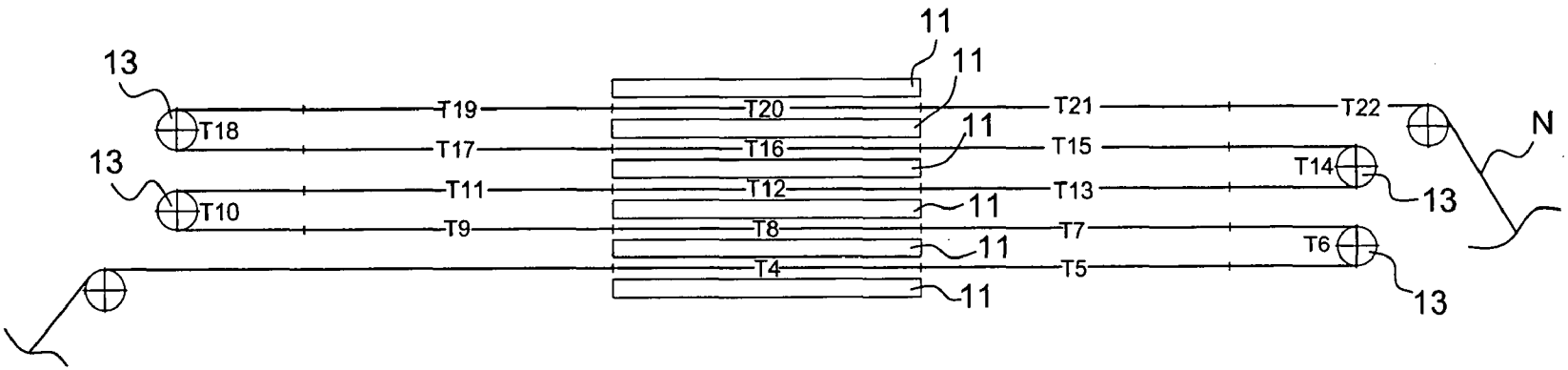
Figure 3D:
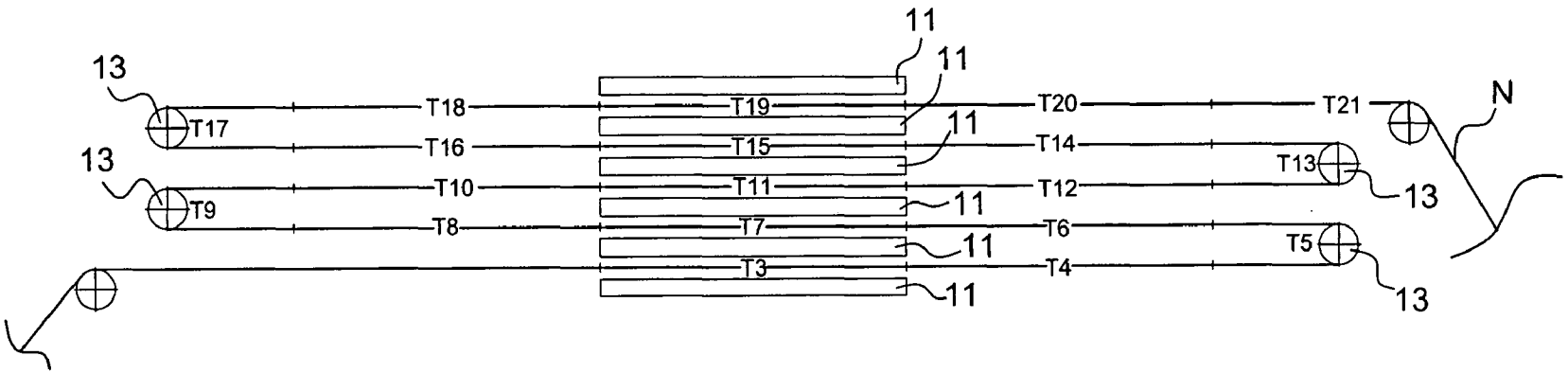
Figure 3E:
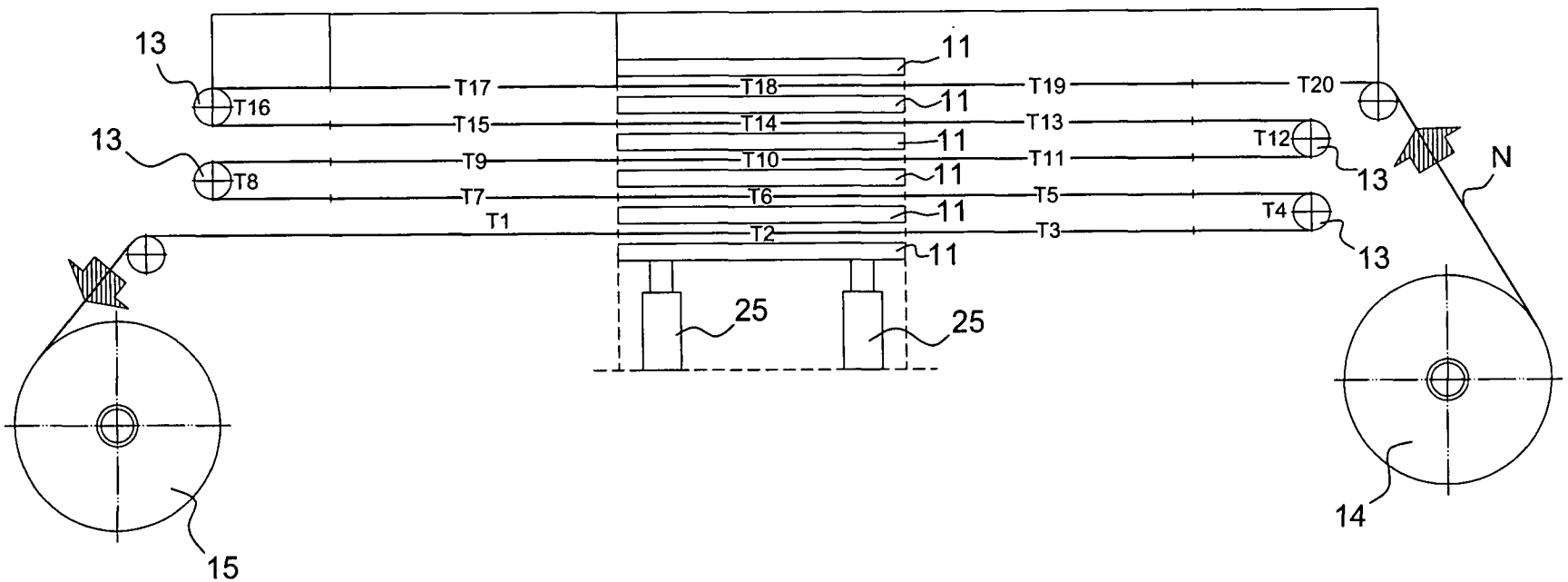
Figure 4:
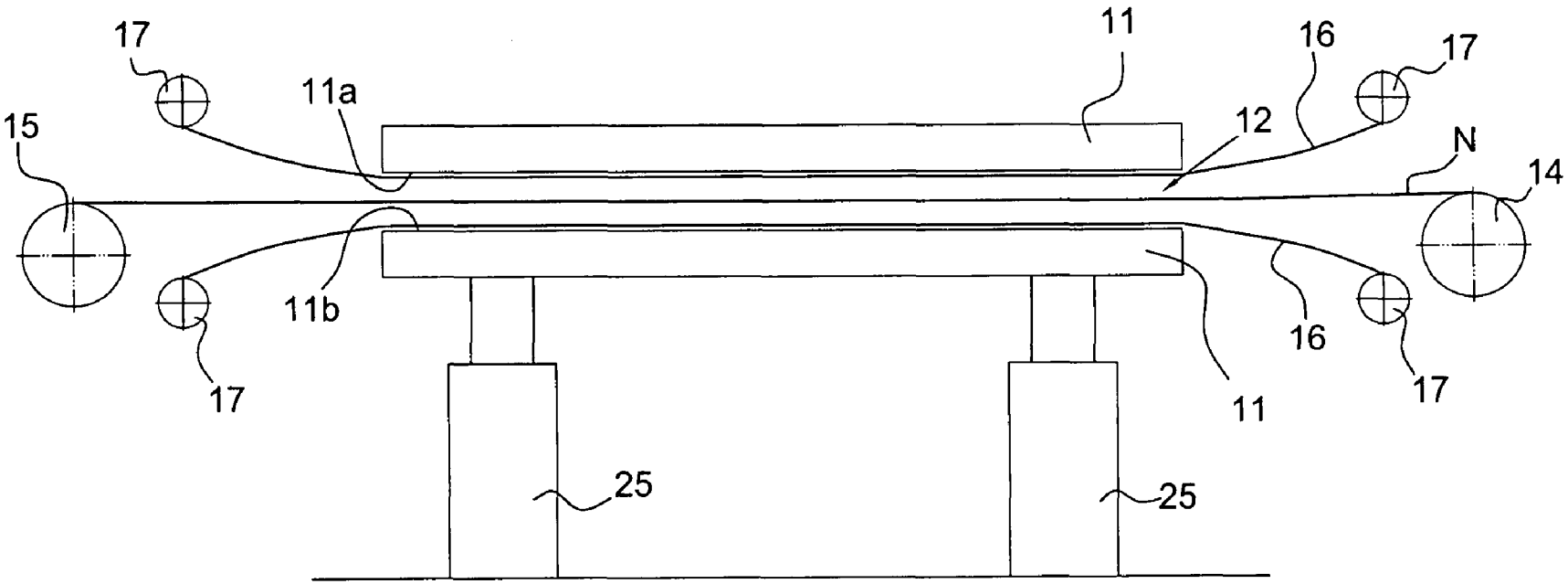
FIG. 4 is a schematic, elevation view of a apparatus, according to an embodiment of the invention for compacting resined webs.

According to another aspect of the invention, with reference to FIG. 2*b*, if one wants to increase the apparatus productivity, a plurality of superimposed compaction plates 11 is provided, with the facing surfaces 11*a*, 11*b* of the plates creating therebetween compaction spaces 12, and a plurality of reels 14, 15 is also provided upstream and downstream of the spaces 12, for moving a plurality of webs N in a number equal to the number of spaces, through said spaces 12.

Consequently, one obtains an undoubted advantage of carrying out the compaction by closure of all the superimposed spaces, with the thrust means 25 arranged below or above the group of superimposed plates, and at the same time, a number of web sections equal to the number of present spaces, is compacted.

According to a different embodiment of the invention, shown in FIGS. 3*a*-3*e*, the apparatus 10 for compacting a continuous web N of flexible fiber-based material includes a plurality of superimposed compacting plates 11, whose facing surfaces 11*a*, 11*b* delimit therebetween compaction spaces 12, and a plurality of turnaround rollers 13, arranged upstream and downstream of the spaces 12, so that the web N moves through said spaces 12 and is compacted by closure of all the superimposed spaces by the thrust means 25.

In this way, only one continuous web is made to pass inside the spaces to be compacted at juxtaposed sections.

The apparatus according to the invention allows compacting continues webs of flexible fiber-based or filament-based material and is used electively, although not exclusively, in the production of protective fabrics for manufacturing garments and barriers, useful to stop the threats and protect from the cutting weapons and sharp bodies also at high speed.

Such fabrics are the base material for the manufacturing of splinter-proof and cut-proof personal protection jacket, safety and shockproof helmets, armoring, composites in general, protection panels and the like.

The term fabric means any fiber-based or filament-based structure, having or not having weft and warp and arranged as mono- or multi-axial, or unidirectional or semi-unidirectional, or chaotic.

Therefore, the apparatus 10 includes a plurality of superimposed plates, whose number consists of preferably from 2 to 15, although structures with a bigger number of plates can be manufactured for particular production needs, or otherwise, series composed of a given number of superimposed plates can be manufactured, having thrust means acting on the entire stack of plates, to compact different webs in parallel, one web for each series of superimposed plates.

The technological compromise is obviously to be sought in the apparatus complexity with respect to high productivity.

In the example embodiment shown in FIGS. 3*a*-3*e* and 5, a press with six superimposed plates 11 has been chosen, which plates delimit five compaction spaces 12 between mutual inner facing surfaces 11*a* and 11*b*.

Thus, the web N slides unwinding from an unwinding reel 14 and passes through the press, to be wound on a winding reel 15.

The path of the web N through the press is given by the plurality of turnaround rollers 13, arranged upstream and downstream of the spaces, so as to wind the web N for about half the circumference of the roller, reversing its movement direction, to send it to the subsequent space.

Thus, in the present case, there are four turnaround rollers 12, which in general terms are one less than the number of the spaces.

Basically, operation of the apparatus for compacting is as follows:

a) closing the apparatus plates 11 for a time defined by the user, so as to compacting a web section;
b) opening the apparatus plates 11;
c) moving the web N by a distance or pitch p substantially equal to the length of the apparatus space 12;
d) repeating the steps a)-c) for a number of times at least correlated to the number of spaces 12;
e) closing the apparatus plates 11 for a time defined by the user, so as to compact a web section;
f) opening the apparatus plates 11;
g) moving the web N for a number P of pitches p correlated to the number of spaces.
h) repeating of the steps a)-g).

The method allows compacting each section or pitch p of the fabric web or another flexible fiber-based material only once, so as to ensure web compaction homogeneity for any number of spaces and thus of passages of the web therethrough.

For example, in case of six plates 11 and five spaces 12, shown in FIGS. 3*a*-3*e*, the operation steps are as described below:

a) closing the apparatus plates 11 for a time defined by the user, so as to compact a web section;
b) opening the apparatus plates 11;
c) moving the web N by a distance or pitch p substantially equal to the length of the space 12 of the apparatus;
d) repeating the steps a)-c) for a number of times n=s/p, where s defines the extension of the fabric from the outlet of a space to the inlet of the next space, and p is the space length (the number n must be an integer, in order to have a correct juxtaposition of the fabric sections);
e) closing the apparatus plates 11 fapparatusor a time defined by the user, so as to carry out the compaction of a web section;
f) opening the apparatus plates 11;
g) moving the web by a number P of pitches p defined by P=V+n (V−1), where V indicates the number of spaces, n is defined previously as the ratio s/p;
h) repeating the steps a)-g).

The web unwinding from the unwinding reel 14, passes through the apparatus plates according to the path indicated by the arrow up to the winding reel 15.

The optimization of the position of the turnaround rollers 13 with respect to the apparatus plates becomes important while designing the apparatus.

Such position, definable as a distance A between the roller axis and the space center, can be calculated by the following relation:

$$A=p/2+p+(p-(\pi*d)/2)/2$$

where p is the pitch or the space length;

d is the diameter of the turnaround roller.

In the example embodiment shown schematically in FIG. 2, a apparatus with six plates 11 and five spaces 12 has been chosen, with a web length, from the outlet of a space to the inlet of the subsequent space, equal to 3 pitches p.

In order to better understand the apparatus operation, five spaces are defined as 12*a*-12*e*, beginning from the lower space, from which the web passes to get to the winding reel.

Moreover, the web is ideally subdivided into a plurality of sections T1, T2, T3, . . . , Tn, whose length p is equal to the spaces pitch.

The following table 1 shows, for each compaction cycle, the feeding of the web sections and their positioning in the five spaces.

TABLE 1

| | cycle no. | space 12a | space 12b | space 12c | space 12d | space 12e |
|---|---|---|---|---|---|---|
| 1st SEQUENCE | 1 | T1 | T5 | T9 | T13 | T17 |
| | 2 | T2 | T6 | T10 | T14 | T18 |
| | 3 | T3 | T7 | T11 | T15 | T19 |
| | 4 | T4 | T8 | T12 | T16 | T20 |
| 2nd SEQUENCE | 5 | T21 | T25 | T29 | T33 | T37 |
| | 6 | T22 | T26 | T30 | T34 | T38 |
| | 7 | T23 | T27 | T31 | T35 | T39 |
| | 8 | T24 | T28 | T32 | T36 | T40 |

Thus, the apparatus operation method is defined, in the example case, in three feeds of one pitch p and one feed of seventeen pitches p, so that each section is pressed only once in one of the five spaces.

In the second sequence, the feeds of the first sequence are repeated, and so on, as it is noted from the table, actually the second sequence reports in the corresponding positions sections numbered from T21 to T40, i.e. twenty more than the first sequence equal to three feeds of a single pitch plus one feed of seventeen pitches.

Naturally, by varying the number of plates and consequently, of the spaces and other apparatus parameters, the feed sequence will also be varied.

For example, for a apparatus with n=4 and V=3, a sequence of four single pitches p, followed by a movement of eleven pitches p, is obtained, as it becomes evident from the following table 2, from which it is deduced that each of the sections is pressed only once by one of the three spaces.

TABLE 2

| | cycle no. | space 12a | space 12b | space 12c |
|---|---|---|---|---|
| 1st | 1 | T1 | T6 | T11 |
| SEQUENCE | 2 | T2 | T7 | T12 |
| | 3 | T3 | T8 | T13 |
| | 4 | T4 | T9 | T14 |
| | 5 | T5 | T10 | T15 |
| 2nd | 6 | T16 | T21 | T26 |
| SEQUENCE | 7 | T17 | T22 | T27 |
| | 8 | T18 | T23 | T28 |
| | 9 | T19 | T24 | T29 |
| | 10 | T20 | T25 | T30 |

Thus, the apparatus operation method is defined, in the example case, in four feeds of one pitch p and one feed of eleven pitches p.

In the second sequence the feeds of the first sequence are repeated and so on.

As it is noted from the table, actually the second sequence reports, in the corresponding positions, sections numbered from T16 to T30, i.e. fifteen more than the first sequence equal to four plus eleven feeds of a single pitch.

The temperature of the plates can be modified and controlled according to the product to be obtained, for example, if a fabric impregnated with liquid resin is compacted, the plates can be either cold or hot, in relation to the resin being used.

For this purpose, the plates have interspaces, inside which the heating or cooling liquid circulates, or electric heating resistor elements are introduced. If the web to be compacted is made of a fabric impregnated with solid or fluid resin, the operation temperature is in the range of 20-350° C.

The specific pressure in operation varies in a range from 1 $kg/cm^2$ to 550 $kg/cm^2$.

The plates can be cooled or heated at each compaction cycle.

Compaction times: depend strictly on the type of impregnating resin, in any case from 3 s to 2 hours (long times in case thermosetting resins are used).

The web winding or unwinding speed varies in relation to the product to be obtained, from 0.1 to 100 m/min, equal to about 0.0016-1.6 m/s.

The fabric moves between the unwinding reel and the winding reel and this movement is controlled by an encoder, or similar device, situated on one or both reels, so as to precisely regulate the pitch p.

Figure 5:
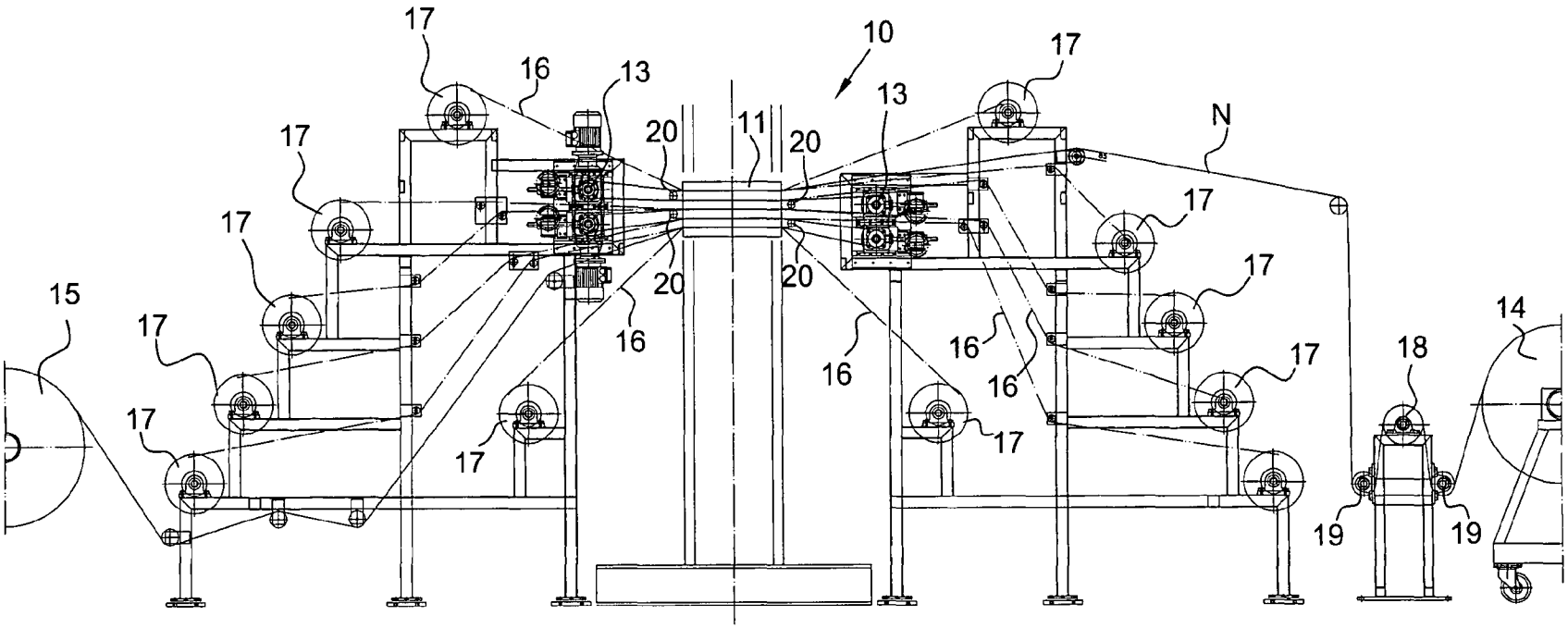
FIG. 5 is a schematic, elevation view of the apparatus of FIGS. 3*a*-3*e* for compacting the resined webs.
Figure 6:
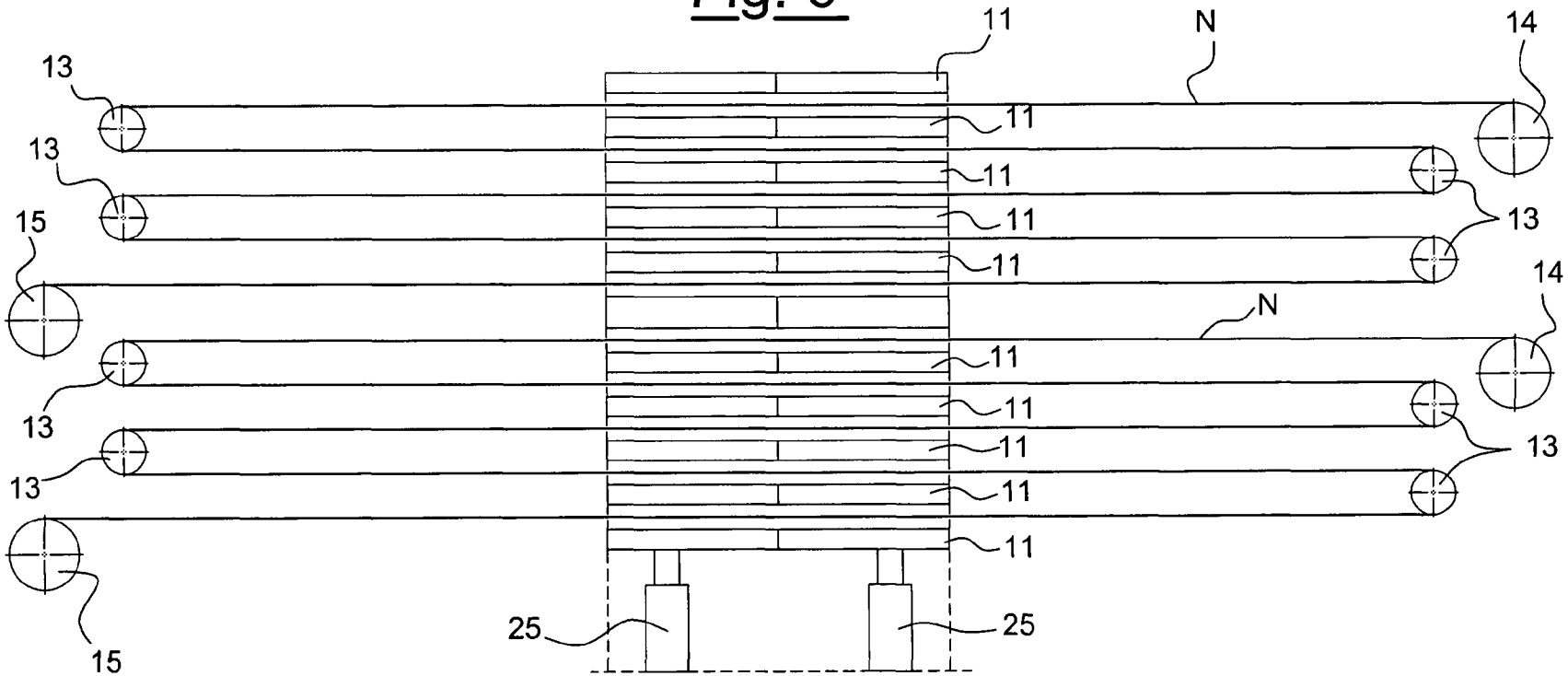
FIG. 6 shows a apparatus for compacting, including two series of superimposed plates.

With reference to FIG. 5, for this purpose, there is a roller 18 set downstream of the unwinding reel for measuring and controlling the unwinding, with related tighteners 19.

In order to keep the tension constant along the whole fabric path, some or all of the turnaround rollers, present between the apparatus spaces, can be motorized.

The tension of the reels, on which the web is wound in the press inlet or outlet, is controlled by suitable brakes or constant tension motors (which keep constant the tension along the winding or unwinding tangent line, as the wound web diameter changes).

If the webs to be compacted are impregnated, it is necessary to arrange siliconized paper 16 to prevent the web from adhering to the hot plates.

The siliconized paper (or release agent) can follow the fabric if the resin is very tacky or remain fixed for a predetermined number of compactions.

According to the embodiment shown in FIG. 5, the siliconized paper 16 is prearranged in such a way, as to be kept in position between the plates for a given number of compactions and to be made move by one pitch p, so that the web is always inserted between two layers of siliconized paper.

For this purpose, there are winding/unwinding spools 17 of the siliconized paper, upstream and downstream of the spaces and turnaround rollers 20 of the siliconized paper, near the apparatus inner spaces.

During a step of compacting, the apparatus space can be opened temporarily, without any web feed, for degassing, so as to allow the humidity present in the fabric to evaporate. The fabric can be impregnated partially or entirely with resin matrices (possibly charged) of any chemical or physical nature, or it can be coupled with one or more adhesive films of any chemical or physical nature, before or during the step of compacting.

The resins or the films can be of any nature, physically solid, or viscous or viscoelastic liquids, thermoplastic, thermosetting or elastomeric or rubbery materials; or mixtures thereof.

In particular, the thermoplastics or thermosetting materials can have mechanical behavior of plastomeric, viscous, viscoelastic, elastomeric or rubbery kind or a mixed behavior thereof.

A possible cross-linking of the resins can occur during the web compaction.

The compaction apparatus according to the present invention is capable of compacting a fiber-based or filament-based continuous web, operating in a discontinuous way with high pressures and reduced dimensions (costs).

Generally, the presses cost is correlated to the plates dimension and above all to the maximum pressure to be reached.

The pressure is the ratio between the force performed by the thrust means on the apparatus plates and the plates surface.

The apparatus according to the example embodiment with five spaces has thrust means of a 600 ton thrust on a surface of the plates of 1300×500 mm, in this case.

The presence of five spaces allows to compact, for each cycle, a surface equal to five times the dimension of the work surface, that is a surface of about 3.25 $m^2$ per compacting.

The price of a single work surface press, capable of pressing at 88 $kg/cm^2$ on the compacting surface is currently about 650,000 Euros (the press would have to have thrust means of the plates with a total thrust of 2,860 tons).

The price of a 5-space innovative apparatus is about 145,000 Euros, plus about 60,000 euros for the additional items.

The advantage of the present invention can be resumed as follows: waste reduction 15/20%, price of the machine less than 30%. Additional benefits come from logistics, with consequent high production savings.

The invention claimed is:

1. Apparatus for compacting a continuous web of flexible material impregnated with a resin or coupled with one or more adhesive films, the apparatus comprising at least one pair of superimposed plates having facing surfaces, said facing surfaces defining at least one compaction space therebetween for compacting the web in presence of a release agent, thrust means adapted to actuate closure of the at least one pair of superimposed plates, at least one unwinding reel and at least one winding reel adapted to allow a controlled advancement of the continuous web along said at least one unwinding reel and at least one winding reel, wherein the at least one unwinding reel and the at least one winding reel are further adapted to allow closure of the at least one pair of superimposed plates for compacting the continuous web, and winding and unwinding spools positioned upstream and downstream of the compaction space to move the release agent through the compaction space independently from the web and preventing the web from touching and adhering to at least one of the pair of superimposed plates during compaction.

2. The apparatus, according to claim 1, wherein said apparatus comprises a plurality of superimposed compaction plates whose facing surfaces define compaction spaces therebetween, and wherein the at least one unwinding reel and at least one winding reel are situated upstream and downstream of the compaction spaces for movement of a plurality of webs through said compaction spaces in a number equal to a corresponding number of compaction spaces.

3. The apparatus, according to claim 1, wherein said apparatus comprises a plurality of superimposed compaction plates and a plurality of turnaround rollers, wherein the plurality of superimposed compaction plates have facing surfaces defining compaction spaces therebetween, and the plurality of turnaround rollers is situated upstream and downstream of the compaction spaces for moving the continuous web through said compaction spaces to a position where said web is subjected to compaction by the closure of the plurality of superimposed compaction plates by the thrust means.

4. The apparatus according to claim 1, wherein said thrust means act on an entire stack of superimposed plates.

5. The apparatus according to claim 1, wherein the at least one pair of superimposed plates have a temperature, and wherein said temperature is modifiable and controllable according to a product to be obtained and/or in relation to a resin comprised in said flexible material.

6. The apparatus according to claim 5, wherein the at least one pair of superimposed plates have interspaces, and wherein the interspaces are adapted for inside circulation of heating or cooling fluid, or include electric heating resistor elements.

7. The apparatus according to claim 6, wherein the controlled advancement of the continuous web is controlled by an encoder, said encoder situated on at least one of the at least one winding reel and the at least one winding reel to regulate a pitch.

8. The apparatus according to claim 7, further comprising a roller and tighteners located downstream of the at least one unwinding reel, the roller for measuring and controlling unwinding of the flexible material with the tighteners.

9. The apparatus according to claim 8, further comprising turnaround rollers disposed in the at least one compaction space, wherein some or all of the turnaround rollers are motorized.

10. The apparatus according to claim 9, further comprising brakes or constant tension motors for controlling a tension of said at least one winding and at least one unwinding reels and wherein the brakes or constant tension motors keep constant a tension along a winding or unwinding tangent as a wound web diameter changes.

11. The apparatus according to claim 10, further comprising an agent for releasing the web from the at least one pair of superimposed plates, the agent in the form of siliconized paper, the agent preventing the web from touching the at least one pair of superimposed plates, the siliconized paper adapted to follow the fabric in its movement or to remain stationary for a defined number of compactions, so that the web is always inserted between two layers of siliconized paper.

* * * * *